US009534498B2

(12) United States Patent
Lyders

(10) Patent No.: US 9,534,498 B2
(45) Date of Patent: Jan. 3, 2017

(54) OVERMOLDED VANE PLATFORM

(71) Applicant: United Technologies Corporation, Hartford, CT (US)

(72) Inventor: David R. Lyders, Middletown, CT (US)

(73) Assignee: United Technologies Corporation, Farmington, CT (US)

( * ) Notice: Subject to any disclaimer, the term of this patent is extended or adjusted under 35 U.S.C. 154(b) by 810 days.

(21) Appl. No.: 13/715,199

(22) Filed: Dec. 14, 2012

(65) Prior Publication Data

US 2014/0169956 A1 Jun. 19, 2014

(51) Int. Cl.

| | |
|---|---|
| ***F01D 5/14*** | (2006.01) |
| ***F01D 5/28*** | (2006.01) |
| ***F01D 9/04*** | (2006.01) |

(52) U.S. Cl.

CPC ..... *F01D 5/147* (2013.01); *F01D 5/288* (2013.01); *F01D 9/042* (2013.01); *F05D 2230/60* (2013.01); *F05D 2230/90* (2013.01); *F05D 2240/12* (2013.01); *F05D 2240/80* (2013.01); *F05D 2300/43* (2013.01)

(58) Field of Classification Search

CPC ..... F01D 5/147; F01D 9/042; F01D 5/288; F01D 2300/43; F01D 5/143; F01D 29/542; F01D 2230/90

See application file for complete search history.

(56) References Cited

U.S. PATENT DOCUMENTS

| | | | | |
|---|---|---|---|---|
| 2,633,628 | A * | 4/1953 | Bartlett | 29/889.7 |
| 4,594,761 | A | 6/1986 | Murphy et al. | |
| 4,722,184 | A | 2/1988 | Chaplin et al. | |
| 4,815,940 | A | 3/1989 | LeShane et al. | |
| 4,832,568 | A | 5/1989 | Roth et al. | |
| 4,900,221 | A | 2/1990 | Ciokajlo et al. | |
| 5,160,251 | A | 11/1992 | Ciokajlo | |
| 5,224,341 | A | 7/1993 | Munroe et al. | |
| 5,272,869 | A * | 12/1993 | Dawson et al. | 60/796 |
| 5,471,743 | A | 12/1995 | Munroe et al. | |
| 5,690,469 | A | 11/1997 | Deal et al. | |
| 5,873,699 | A | 2/1999 | Watson et al. | |
| 5,927,130 | A | 7/1999 | Watson et al. | |
| 6,195,983 | B1 | 3/2001 | Wadia et al. | |
| 6,196,794 | B1 * | 3/2001 | Matsumoto | 415/191 |
| 6,420,509 | B1 | 7/2002 | Putnam et al. | |
| 6,494,032 | B2 | 12/2002 | Udall et al. | |
| 6,554,564 | B1 | 4/2003 | Lord | |
| 6,619,917 | B2 | 9/2003 | Glover et al. | |
| 6,766,639 | B2 | 7/2004 | Malmborg | |
| 6,910,860 | B2 | 6/2005 | Glover et al. | |
| 7,266,941 | B2 | 9/2007 | Eleftheriou et al. | |
| 7,334,998 | B2 | 2/2008 | Jones et al. | |
| 7,565,796 | B2 | 7/2009 | Eleftheriou et al. | |
| 7,614,848 | B2 | 11/2009 | Bogue et al. | |
| 7,730,715 | B2 | 6/2010 | Grudnoski et al. | |
| 7,739,866 | B2 | 6/2010 | Eleftheriou et al. | |
| 7,765,787 | B2 | 8/2010 | Eleftheriou et al. | |

(Continued)

OTHER PUBLICATIONS

International search report for PCT/US2013/074741 dated Apr. 9, 2014.

*Primary Examiner* — Troy Chambers

*Assistant Examiner* — Joshua Semick

(74) *Attorney, Agent, or Firm* — O'Shea Getz P.C.

(57) ABSTRACT

A vane includes a platform with a fixture overmolded by a sheath.

17 Claims, 5 Drawing Sheets

(56) References Cited

U.S. PATENT DOCUMENTS

| | | | | |
|---|---|---|---|---|
| 7,770,378 | B2 | 8/2010 | Eleftheriou et al. | |
| 7,793,488 | B2 | 9/2010 | Eleftheriou et al. | |
| 7,797,922 | B2 | 9/2010 | Eleftheriou et al. | |
| 7,926,291 | B1 | 4/2011 | Wilson, Jr. | |
| 9,157,454 | B2 * | 10/2015 | Perrollaz | F01D 9/042 |
| 2004/0033137 | A1 | 2/2004 | Glover et al. | |
| 2005/0048218 | A1 * | 3/2005 | Weidman | 427/446 |
| 2008/0038113 | A1 | 2/2008 | Matsumoto et al. | |
| 2011/0150643 | A1 * | 6/2011 | Wery et al. | 415/200 |

* cited by examiner

OVERMOLDED VANE PLATFORM

BACKGROUND

The present disclosure relates to a gas turbine engine, and more particularly, although not exclusively, to an overmolded airfoil structure.

Gas turbine engines generally include a fan section and a core section in which the fan section defines a larger diameter than that of the core section. The fan section and the core section are disposed about a longitudinal axis and are enclosed within an engine nacelle assembly. Combustion gases are discharged from the core section through a core exhaust nozzle while an annular fan bypass flow, disposed radially outward of the primary core exhaust path, is discharged along a fan bypass flow path and through an annular fan exhaust nozzle. A majority of thrust is produced by the fan bypass flow while the remainder is provided by the combustion gases.

Guide vanes extend between a fan case of the fan section and a core case of the core section and guide the fan bypass flow. The guide vanes are attached to the fan case and the compressor case with a multiple of bolts which extend through a structurally capable vane end fitting of each guide vane. As there may be upwards of fifty such vanes, the cumulative weight of the fittings and fasteners may be relatively significant. Furthermore, the vane end fitting interface need provide the desired aerodynamic flow path effect yet needs to endure the pounding of the adjacent rotating fan blades as well as remain resistant to foreign object damage (FOD).

SUMMARY

A vane according to one disclosed non-limiting embodiment of the present disclosure includes a platform with a fixture overmolded by a sheath.

In a further embodiment of the foregoing embodiment, the platform is an inner platform of a structural guide vane.

In a further embodiment of any of the foregoing embodiments, the platform is an outer platform of a structural guide vane.

In a further embodiment of any of the foregoing embodiments, the fixture is manufactured of a metallic alloy material. In the alternative or additionally thereto, in the foregoing embodiment the sheath is manufactured of a thermoplastic material.

In a further embodiment of any of the foregoing embodiments, the fixture is manufactured of a composite material. In the alternative or additionally thereto, in the foregoing embodiment the sheath is manufactured of a thermoplastic material.

In a further embodiment of any of the foregoing embodiments, the sheath is manufactured of a thermoplastic material.

In a further embodiment of any of the foregoing embodiments, the vane includes an airfoil mountable to said fixture. In the alternative or additionally thereto, the foregoing embodiment includes a vane mount which extends from a base, said vane mount operable to at lest partially receive said airfoil. In the alternative or additionally thereto, in the foregoing embodiment the fixture is "bone" shaped. In the alternative or additionally thereto, the foregoing embodiment includes at least one aperture to receive a fastener.

In a further embodiment of any of the foregoing embodiments, the vane includes an airfoil that extends from and is integral with said fixture.

A gas turbine engine according to another disclosed non-limiting embodiment of the present disclosure includes a fan case, a core case, a structural guide vane mounted between said fan case and said core case, said structural guide vane includes an inner platform and an outer platform that include a fixture overmolded by a sheath.

In a further embodiment of the foregoing embodiment, the fixture is "bone" shaped.

In a further embodiment of any of the foregoing embodiments, the fixture includes at least one aperture to receive a fastener.

In a further embodiment of any of the foregoing embodiments, the structural guide vane includes an airfoil mountable between said inner platform and said outer platform.

A method of manufacturing a platform for a vane of a gas turbine engine according to another disclosed non-limiting embodiment of the present disclosure includes overmolding a fixture with a sheath.

In a further embodiment of the foregoing embodiment, the method includes overmolding the fixture with a thermoplastic sheath.

In a further embodiment of any of the foregoing embodiments, the method includes defining a portion of an aerodynamic radial boundary of a fan bypass flow path with the sheath.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
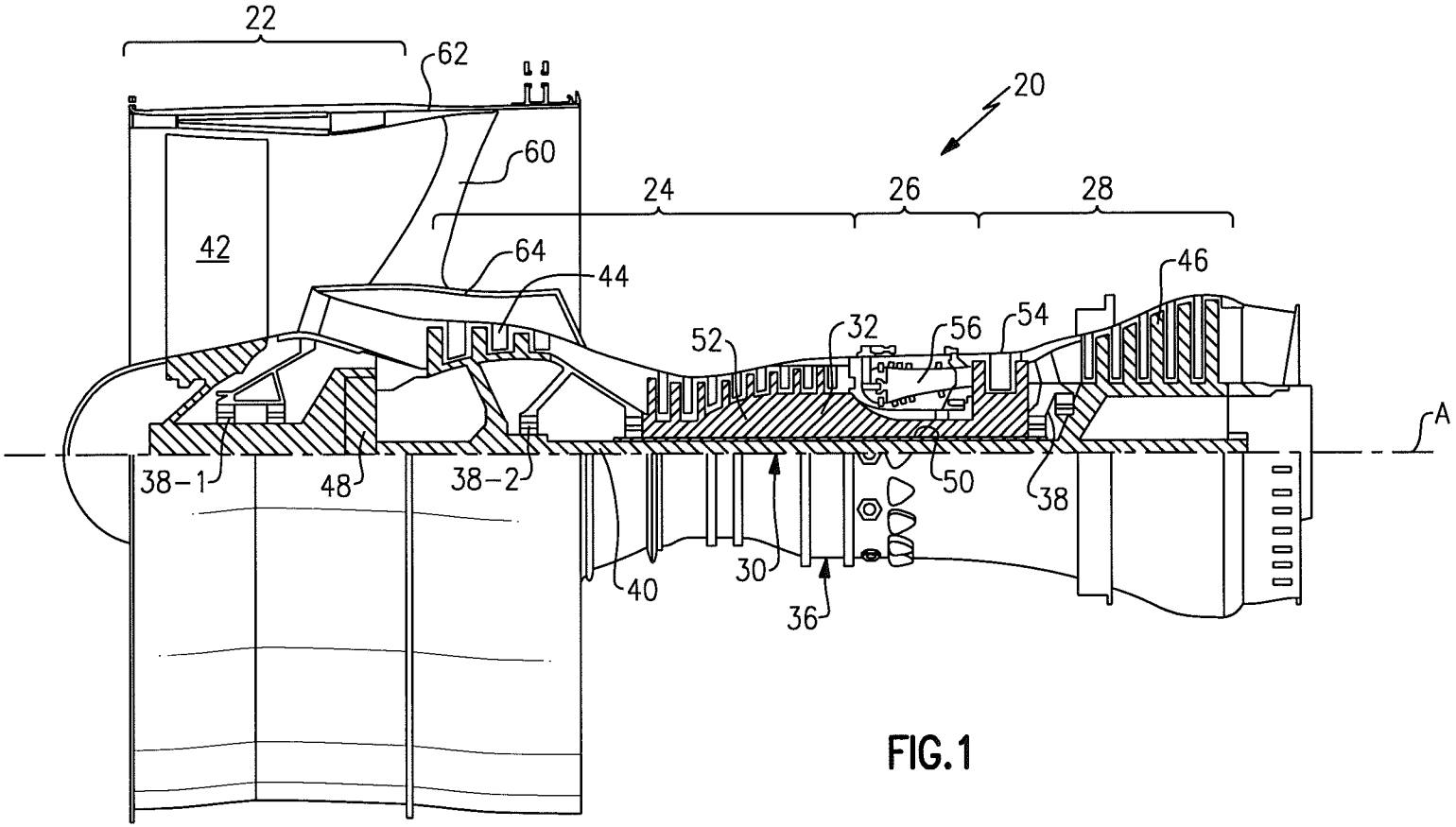
FIG. 1 is a schematic cross-section of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines such as a three-spool (plus fan) engine wherein an intermediate spool includes an intermediate pressure compressor (IPC) between the LPC and HPC and an intermediate pressure turbine (IPT) between the HPT and LPT.

The engine 20 generally includes a low spool 30 and a high spool 32 mounted for rotation about an engine central longitudinal axis A relative to an engine static structure 36 via several bearing structures 38. The low spool 30 generally includes an inner shaft 40 that interconnects a fan 42, a low pressure compressor 44 ("LPC") and a low pressure turbine 46 ("LPT"). The inner shaft 40 drives the fan 42 through a geared architecture 48 to drive the fan 42 at a lower speed than the low spool 30.

The high spool 32 includes an outer shaft 50 that interconnects a high pressure compressor 52 ("HPC") and high pressure turbine 54 ("HPT"). A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

Core airflow is compressed by the low pressure compressor 44 then the high pressure compressor 52, mixed with the fuel and burned in the combustor 56, then expanded over the high pressure turbine 54 and the low pressure turbine 46. The turbines 54, 46 rotationally drive the respective low spool 30 and high spool 32 in response to the expansion.

In one non-limiting example, the gas turbine engine 20 is a high-bypass geared architecture engine in which the bypass ratio is greater than about six (6:1). The geared architecture 48 can include an epicyclic gear train, such as a planetary gear system, star gear system or other gear system. The example epicyclic gear train has a gear reduction ratio of greater than about 2.3, and in another example is greater than about 2.5. The geared turbofan enables operation of the low spool 30 at higher speeds which can increase the operational efficiency of the low pressure compressor 44 and low pressure turbine 46 and render increased pressure in a fewer number of stages.

A pressure ratio associated with the low pressure turbine 46 is pressure measured prior to the inlet of the low pressure turbine 46 as related to the pressure at the outlet of the low pressure turbine 46 prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 44, and the low pressure turbine 46 has a pressure ratio that is greater than about five (5:1). It should be understood, however, that the above parameters are only exemplary of one embodiment of a geared architecture engine and that the present disclosure is applicable to other gas turbine engines including direct drive turbofans.

In one embodiment, a significant amount of thrust is provided by the bypass flow path due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $(\text{"T"}/518.7)^{0.5}$. in which "T" represents the ambient temperature in degrees Rankine. The Low Corrected Fan Tip Speed according to one non-limiting embodiment of the example gas turbine engine 20 is less than about 1150 fps (351 m/s).

Figure 2:
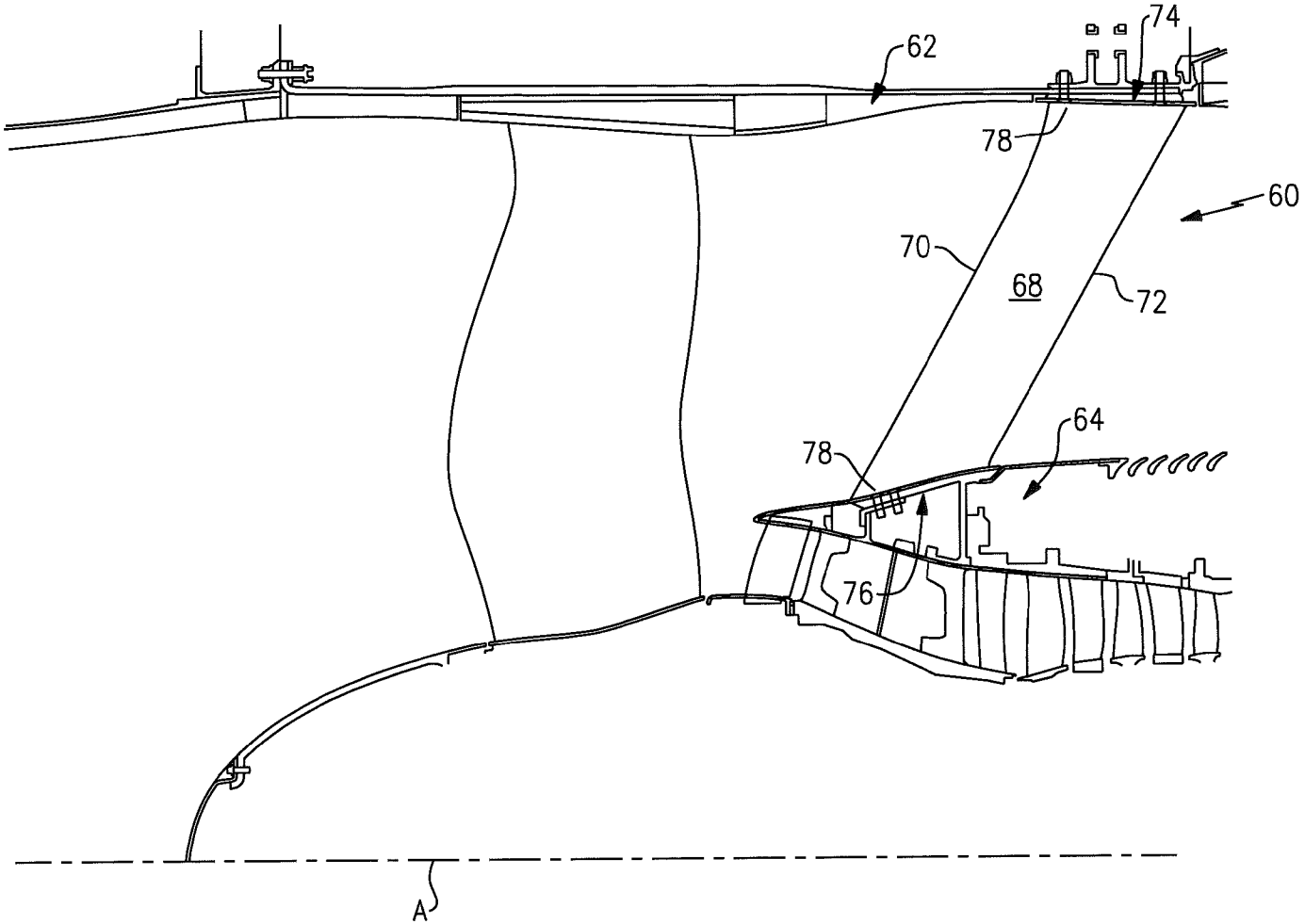
FIG. 2 is an expanded view of a vane within a fan bypass flow path of the gas turbine engine.
Figure 3:
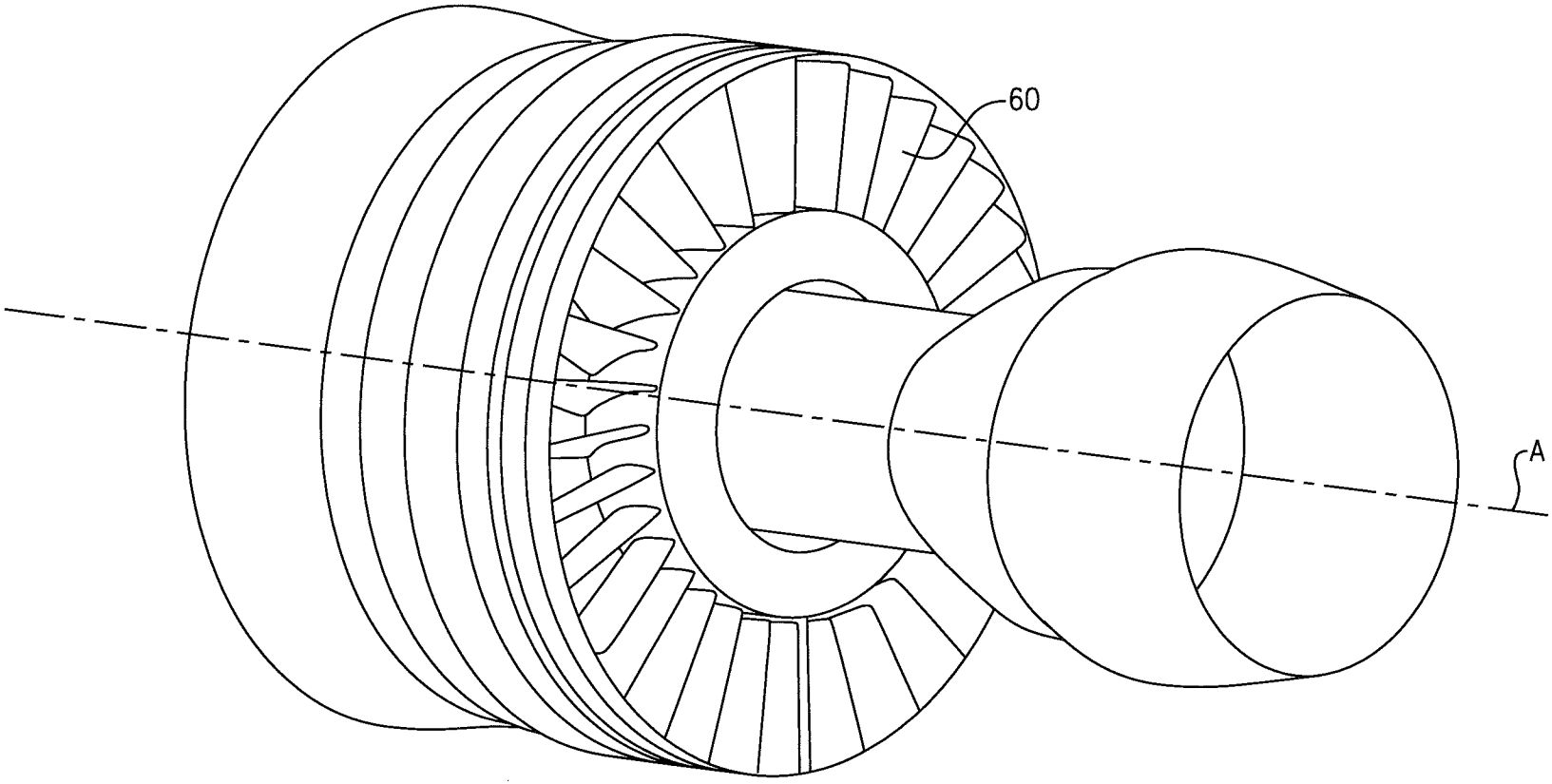
FIG. 3 is an rear perspective view of the gas turbine engine.

With reference to FIG. 2, a plurality of guide vanes 60 extend between a fan case 62 of the fan section 22 and a core case 64 of a core section 66 to support the fan case 62 relative to the core case 64. It should be understood that the fan case 62 and the core case 64 may include a multiple of case sections or engine modules. It should also be understood that the fan case 62, the core case 64 and the plurality of guide vanes 60 which extend therebetween may be, for example, a complete module often referred to as an intermediate case. Although structural guide vanes are illustrated in the disclosed, non-limiting embodiment, it should be still further appreciated that other vane structures such as non-structural fan exit guide vanes, stators, case struts, fan blade platforms, and any component with a controlled surface around an attachment feature inclusive of non-aerospace components.

The plurality of guide vanes 60 are circumferentially spaced and radially extend with respect to the engine axis A to guide the fan bypass flow. Each of the plurality of guide vanes 60 are defined by an airfoil section 68 defined between a leading edge 70 and a trailing edge 72. The airfoil section 68 forms a generally concave shaped portion to form a pressure side 68P and a generally convex shaped portion to form a suction side 68S. It should be appreciated that subsets of the the plurality of structural guide vanes 60 may define different airfoil profiles to effect downstream flow adjustment of the fan bypass flow, to for example, direct flow at least partially around an upper and lower bi-fi (not shown) or other structure in the fan bypass flow path.

In one disclosed non-limiting embodiment, the airfoil section 68 is located between an outer platform 74 and an inner platform 76 which respectively attach to the fan case 62 and the core case 64. The outer platform 74 and the inner platform 76 each include a fixture 78 to which an aerodynamic sheath 80 is overmolded. For example, the fixture 78 may be manufactured of a metallic, composite, ceramic or other structural material while the sheath 80 may be manufactured of a thermoplastic or other non-structural material so as to define the outer shape of the vane 60.

In one disclosed, non-limiting embodiment, the fixture 78 includes a vane mount 82 that extends transversely to a base 84. The shape of the base 84 may be configured for the interface or structural rational. That is, the base may be optimized to meet structural and interface requirements to facilitate a lightweight structure. The base 84 in one example may be generally "bone-shaped" with two (2) apertures 86 to receive fasteners 88 such as bolts with an aft section 90 that is generally thicker than a forward section 92 to facilitate, for example only, fatigue resistance.

The vane mount 82 is generally airfoil shaped to receive an extension 94 from the airfoil section 68. The extension 94 may be an integral portion of the airfoil section 68 or may alternatively be a structural support which itself is overmolded by an airfoil-shaped sheath. The extension 94 fits within the vane mount 82 in a slip fit or interference arrangement and may be bonded or otherwise attached within the vane mount 82. That is, the extension 94 closely fits within the vane mount and be of various configurations with a cross-section generally equivalent or different than that of the airfoil section 68.

The sheath 80 at least partially surrounds the fixture 78 to define the aerodynamic contour to the outer platform 74 and an inner platform 76. That is, the sheath 80 replaces the relatively heavier weight metal with an injection molded material in non-structural regions to provide weight reduction. As the injection molded material is molded around the metallic skeleton of the fixture 78, and not secondarily bonded or attached thereto, tolerances are may be held relatively tighter to yield reduced aerodynamic variation.

The reduced aerodynamic variation may beneficially eliminate a seal structure between the platforms, 74, 76 and the airfoil section 68 to minimize or eliminate aerodynamic losses associated therewith reduce manufacturing complexity. The Injection molded flow path of the sheath 80 is may also be low profile as no additional attachment features are required which results in a relative increase in flow area and reduced blockage within the fan bypass flow path to achieve increased aerodynamic performance.

Figure 4:
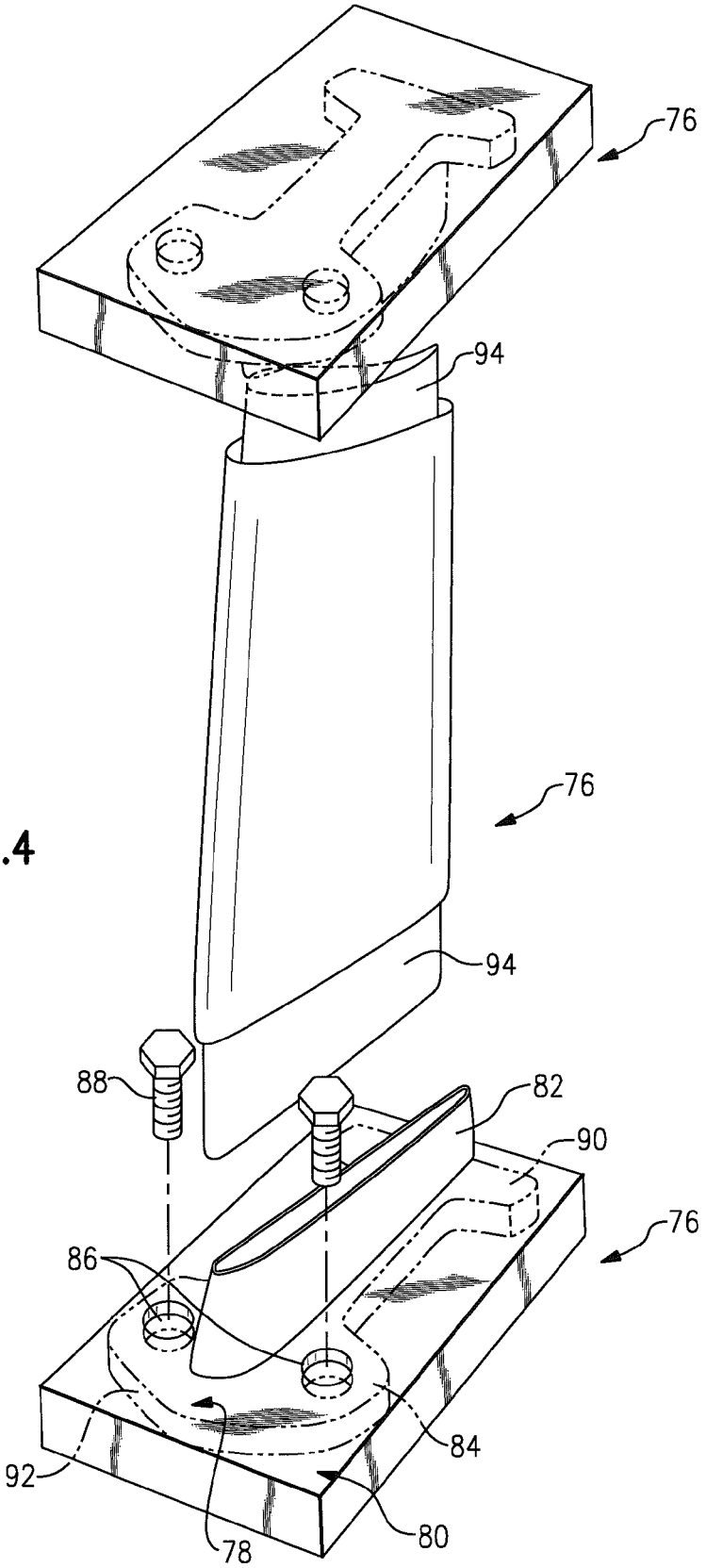
FIG. 4 is an exploded view of a vane according to one disclosed non-limiting embodiment.
Figure 5:
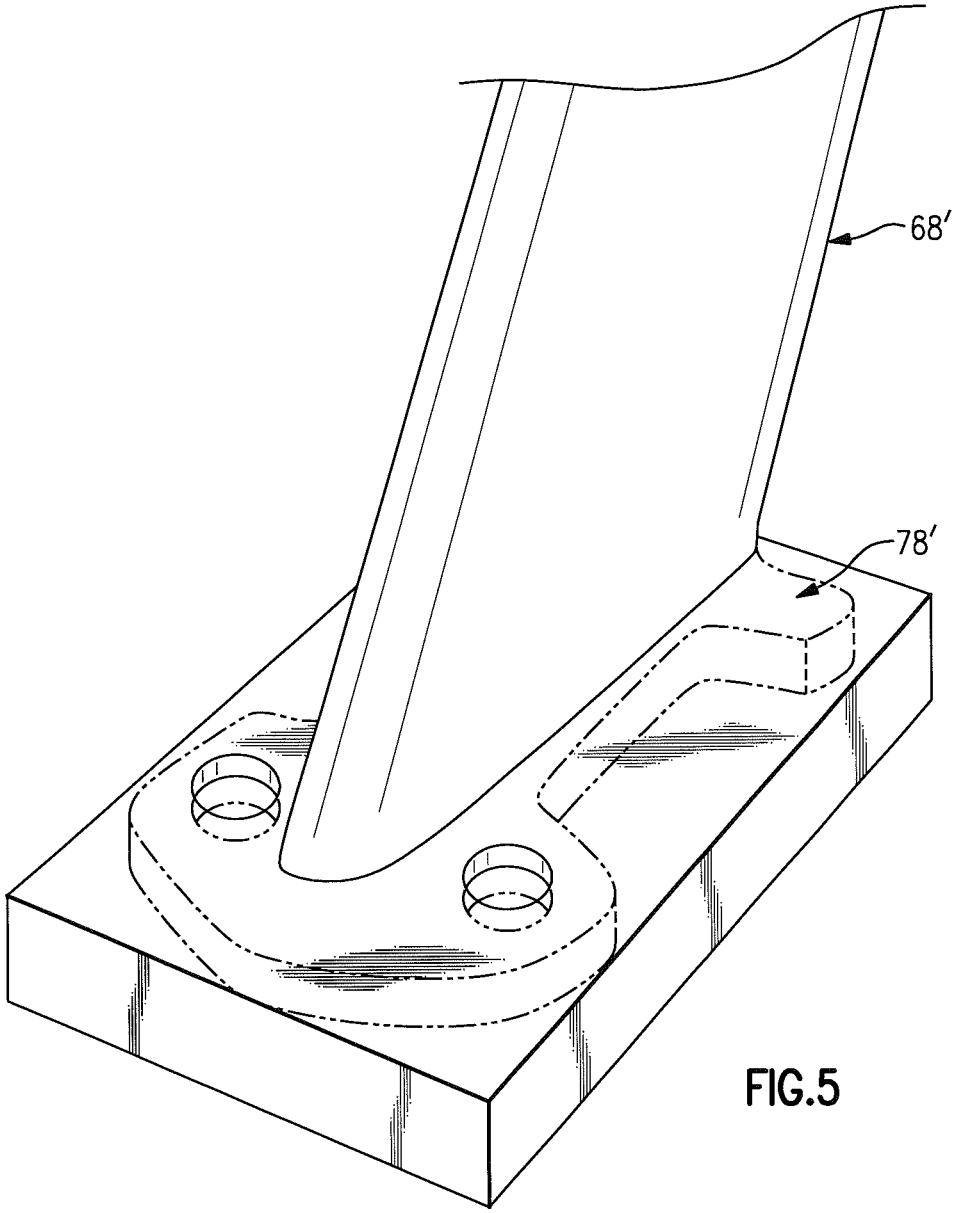
FIG. 5 is a perspective view of a vane according to another disclosed non-limiting embodiment.

With reference to FIG. 4, another disclosed non-limiting embodiment integrates an airfoil section 68' with respective fixtures 78'. That is, the airfoil section 68' with a respective fixtures 78' is a single "I" shaped component which may be manufactured of a metallic or composite material to provide an integrals structural support. The fixtures 78' are then overmolded by the thermoplastic material to form an aerodynamic sheath 80 around the fixtures 78' which may blend onto the airfoil section 68'.

It should be understood that relative positional terms such as "forward," "aft," "upper," "lower," "above," "below," "bottom", "top", and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A vane, comprising:

a platform with a fixture overmolded by a sheath, wherein said fixture is manufactured of a composite material.

2. The vane as recited in claim 1, wherein said platform is an inner platform of a structural guide vane.

3. The vane as recited in claim 1, wherein said platform is an outer platform of a structural guide vane.

4. The vane as recited in claim 1, wherein said sheath is manufactured of a thermoplastic material.

5. The vane as recited in claim 1, further comprising an airfoil mountable to said fixture.

6. The vane as recited in claim 5, wherein said fixture includes a vane mount which extends from a base, said vane mount operable to at least partially receive said airfoil.

7. The vane as recited in claim 6, wherein said base is "bone" shaped.

8. The vane as recited in claim 1, wherein said fixture includes at least one aperture to receive a fastener.

9. The vane as recited in claim 1, further comprising an airfoil that extends from and is integral with said fixture.

10. A gas turbine engine, comprising:

a fan case;

a core case;

a structural guide vane mounted between said fan case and said core case, said structural guide vane includes an inner platform that includes a first fixture and an outer platform that includes a second fixture, the first fixture overmolded by a first sheath and the second fixture overmolded by a second sheath, wherein an entirety of at least one of said first or second fixtures is manufactured of a composite material.

11. The gas turbine engine as recited in claim 10, wherein a base of at least one of said first or second fixtures is "bone" shaped.

12. The gas turbine engine as recited in claim 10, wherein at least one of said first or second fixtures includes at least one aperture to receive a fastener.

13. The gas turbine engine as recited in claim 10, wherein said structural guide vane includes an airfoil mountable between said inner platform and said outer platform.

14. A method of manufacturing a platform for a vane of a gas turbine engine comprising:

overmolding a fixture with a sheath, wherein an entirety of said fixture is manufactured of a composite material.

15. The method as recited in claim 14, further comprising:

overmolding the fixture with a thermoplastic material to form the sheath.

16. The method as recited in claim 14, further comprising:

defining a portion of an aerodynamic radial boundary of a fan bypass flow path with the sheath.

17. The vane as recited in claim 1, wherein an entirety of said fixture is manufactured of the composite material.

* * * * *